US008209880B2

(12) United States Patent
Kim

(10) Patent No.: US 8,209,880 B2
(45) Date of Patent: Jul. 3, 2012

(54) DRYER AND METHOD OF CONTROLLING THE SAME

(75) Inventor: Chang Hoo Kim, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 486 days.

(21) Appl. No.: 12/490,547

(22) Filed: Jun. 24, 2009

(65) Prior Publication Data

US 2009/0320322 A1 Dec. 31, 2009

(30) Foreign Application Priority Data

Jun. 27, 2008 (KR) ..... 10-2008-0061339

(51) Int. Cl.
*F26B 5/00* (2006.01)

(52) U.S. Cl. ..... 34/497; 34/601; 700/275

(58) Field of Classification Search ..... 34/318, 34/497, 499, 130, 601, 610, 90; 700/725
See application file for complete search history.

(56) References Cited

U.S. PATENT DOCUMENTS

| | | | | |
|---|---|---|---|---|
| 3,479,492 | A * | 11/1969 | Koppel et al. | 700/41 |
| 4,489,455 | A * | 12/1984 | Spendel | 8/158 |
| 5,376,045 | A * | 12/1994 | Kiser | 454/229 |
| 7,162,812 | B2 * | 1/2007 | Cimetta et al. | 34/469 |
| 7,257,905 | B2 * | 8/2007 | Guinibert et al. | 34/82 |
| 7,418,789 | B2 * | 9/2008 | Choi et al. | 34/380 |
| 7,921,578 | B2 * | 4/2011 | McAllister et al. | 34/597 |
| 2004/0045187 | A1 * | 3/2004 | Curry et al. | 34/595 |
| 2005/0076535 | A1 * | 4/2005 | Guinibert et al. | 34/601 |
| 2006/0130354 | A1 * | 6/2006 | Choi et al. | 34/73 |
| 2009/0282696 | A1 * | 11/2009 | Kim et al. | 34/493 |
| 2009/0320322 | A1 * | 12/2009 | Kim | 34/499 |

FOREIGN PATENT DOCUMENTS

| | | | |
|---|---|---|---|
| JP | 05293295 | A * | 11/1993 |
| JP | 2000329468 | A * | 11/2000 |

* cited by examiner

*Primary Examiner* — Stephen M. Gravini
(74) *Attorney, Agent, or Firm* — Occhiuti Rohlicek & Tsao LLP

(57) ABSTRACT

Disclosed herein is a dryer having a function of spraying steam onto laundry. The dryer includes a cabinet, a drum rotatably disposed inside the cabinet, an exhaust part communicating with the drum and provided with a ventilation fan, a drive unit rotating the drum and the ventilation fan; and a drive force transmission unit selectively transmitting a drive force from the drive unit to the ventilation fan. A method of controlling the dryer is also disclosed.

11 Claims, 9 Drawing Sheets

DRYER AND METHOD OF CONTROLLING THE SAME

CROSS-REFERENCE TO RELATED APPLICATIONS

The present application claims priority to Korean patent application number 10-2008-0061339, filed on Jun. 27, 2008, which is incorporated by reference in its entirety.

BACKGROUND OF THE INVENTION

1. Field of the Invention

The present invention relates to a dryer and, more particularly, to a dryer having a function of spraying steam and a method of controlling the same.

2. Description of the Related Art

FIG. 1 is a schematic sectional view showing a flow passage of a conventional dryer, and FIG. 2 is a partially cross-sectional view of the conventional dryer.

Referring to FIGS. 1 and 2, the conventional dryer includes a cabinet 2 constituting an outer appearance of the dryer and having an opening through which laundry is input or removed; a drum 12 rotatably disposed inside the cabinet 2 to receive the laundry and opened at front and rear sides to allow air to pass therethrough; a heater 18 disposed inside the cabinet 2 to heat air introduced into the cabinet 2; an intake duct 20 guiding air heated by the heater 18 to the rear of the drum 12; an exhaust mechanism 22 for discharging air, which is used to dry the laundry, to an outside of the cabinet 2; a ventilation fan 30 provided to the exhaust mechanism 22; a motor 40 driving the drum 12 and the ventilation fan 30 and connected to a belt 50 transmitting a drive force from the motor 40 to the drum 12.

The exhaust mechanism 22 includes a lint duct 25 defining a flow passage of air discharged from the drum 12 and having a filter to separate foreign matter from air passing through the lint duct 25, a fan housing 26 communicating with the lint duct 25 and surrounding the ventilation fan 30, and an exhaust duct 27 communicating at one end thereof with the fan housing 26 and having the other end disposed outside the cabinet 2.

The motor 40 is provided with a rotational shaft 41. The rotational shaft 41 is connected at one end thereof to the ventilation fan 30 and at the other end to the belt 50 such that the ventilation fan 30 and the drum 12 are simultaneously rotated when the motor 40 is driven.

Further, the dryer may be provided with a steam generator (not shown). The steam generator sprays steam into the drum 12 before or during a drying operation to smooth out creases in laundry.

In the conventional dryer, the ventilation fan and the drum are simultaneously rotated or stopped by the motor in which opposite sides of a rotational shaft are integrally rotated. In other words, when the drum is rotated, the ventilation fan is also rotated.

As a result, when steam is sprayed from the steam generator, the ventilation fan is rotated along with the drum, thereby causing most of the steam to be discharged by the exhaust mechanism without contacting the laundry. Moreover, when the rotation of the drum is stopped, the steam is brought into contact with a portion of the laundry. Therefore, there is a need for an improved dryer that overcomes these problems.

SUMMARY OF THE INVENTION

The present invention is conceived to solve the above and other problems of the related art, and an aspect of the present invention is to provide a dryer configured to allow steam to be uniformly sprayed from a steam generator onto laundry.

In accordance with one aspect of the present invention, a dryer includes: a cabinet; a drum rotatably disposed inside the cabinet; an exhaust part communicating with the drum and provided with a ventilation fan; a drive unit rotating the drum and the ventilation fan; and a drive force transmission unit selectively transmitting a drive force from the drive unit to the ventilation fan.

The drive unit may include a dual-shaft motor including a first rotational shaft rotating the ventilation fan and a second rotational shaft rotating the drum.

The drive force transmission unit may include a first connection part coupled to a central shaft of the ventilation fan to be moved in an axial direction of the ventilation fan; a second connection part to which the first connection part is rotatably connected, the second connection part connecting or disconnecting the first connection part to or from the first rotational shaft; and a moving part moving the second connection part.

The first rotational shaft may be formed with a protrusion and the first connection part may be formed with a depression engaging with the protrusion.

The first connection part may be inserted into the central shaft of the ventilation fan, and an elastic member may be disposed between the first connection part and the ventilation fan.

One of the central shaft of the ventilation fan and the first connection part may be formed with a coupling protrusion and the other may be formed with a coupling groove engaging with the coupling protrusion.

The coupling protrusion may include a ball-spring.

The drive force transmission unit may include a first connection part coupled to the first rotational shaft to be moved in an axial direction of the first rotational shaft; a second connection part to which the first connection part is rotatably connected, the second connection part connecting or disconnecting the first connection part to or from the central shaft of the ventilation fan; and a moving part moving the second connection part.

The dryer may further include a steam supply unit disposed inside the cabinet and spraying steam into the drum.

The dryer may further include a controller which operates the drive force transmission unit when the steam generator is operated.

In accordance with another aspect of the present invention, a method of controlling a dryer includes: sending a steam supply command to a controller which controls steam spray; operating, by the controller, a drive force transmission unit to block a drive force from being transmitted from a drive unit to a ventilation fan; operating, by the controller, the drive unit to rotate a drum; and operating, by the controller, a steam supply unit to spray steam into the drum.

BRIEF DESCRIPTION OF THE DRAWINGS

The above and other aspects, features and advantages of the present invention will become apparent from the following detailed description in conjunction with the accompanying drawings, in which.

DETAILED DESCRIPTION OF THE EMBODIMENT

Hereinafter, exemplary embodiments of the present invention will be described in detail with reference to the accompanying drawings. It should be noted that the drawings are not to precise scale and may be exaggerated in thickness of lines or sizes of components for descriptive convenience and clarity. Furthermore, the terms as used herein are defined by taking functions of the present invention into account and can be changed according to the custom or intention of users or operators. Therefore, definition of the terms should be made according to the entirety of the disclosure set forth herein.

Figure 1:
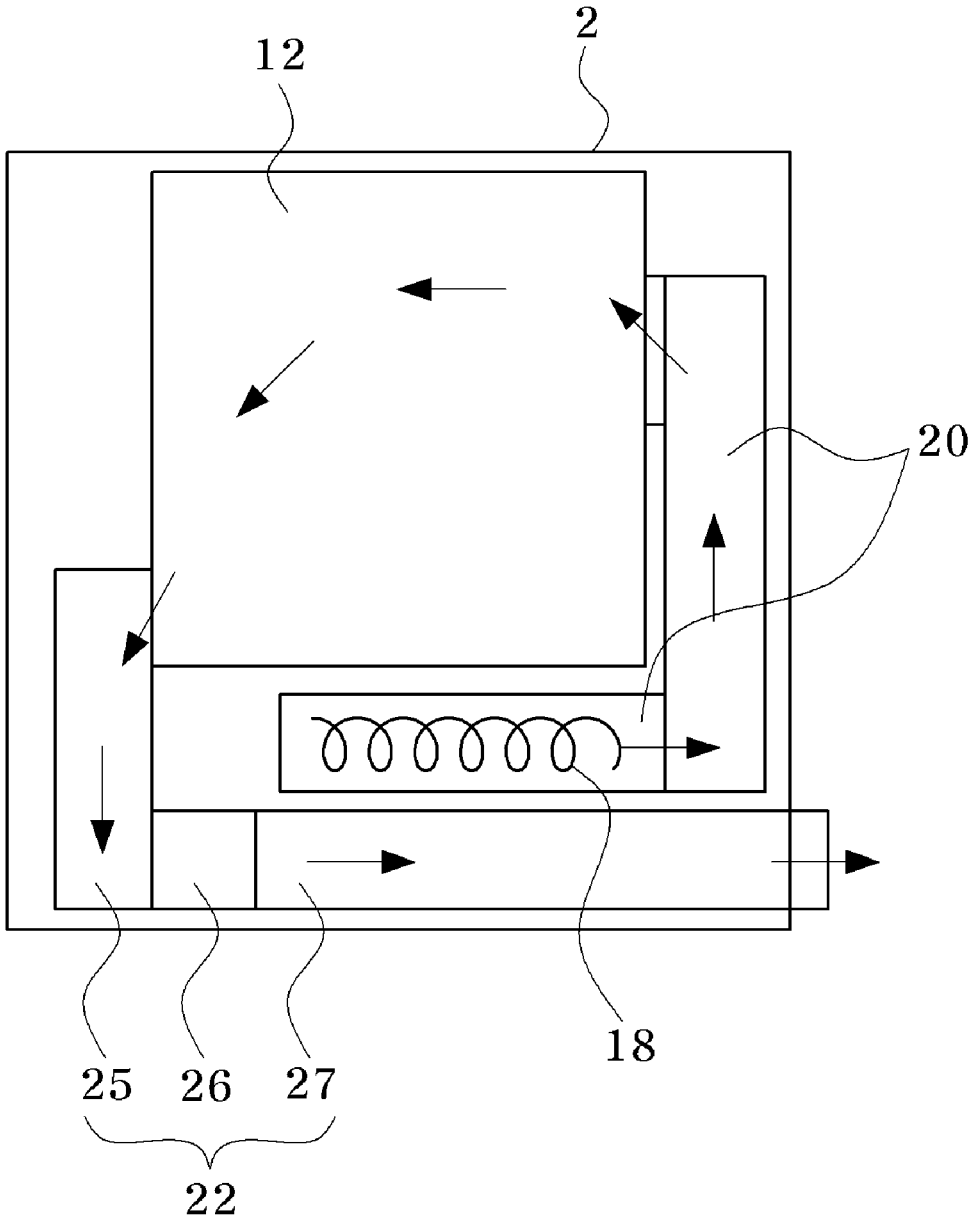
Fig. 1 Prior Art
FIG. 1 is a schematic sectional view showing a flow passage of a conventional dryer.
Figure 2:
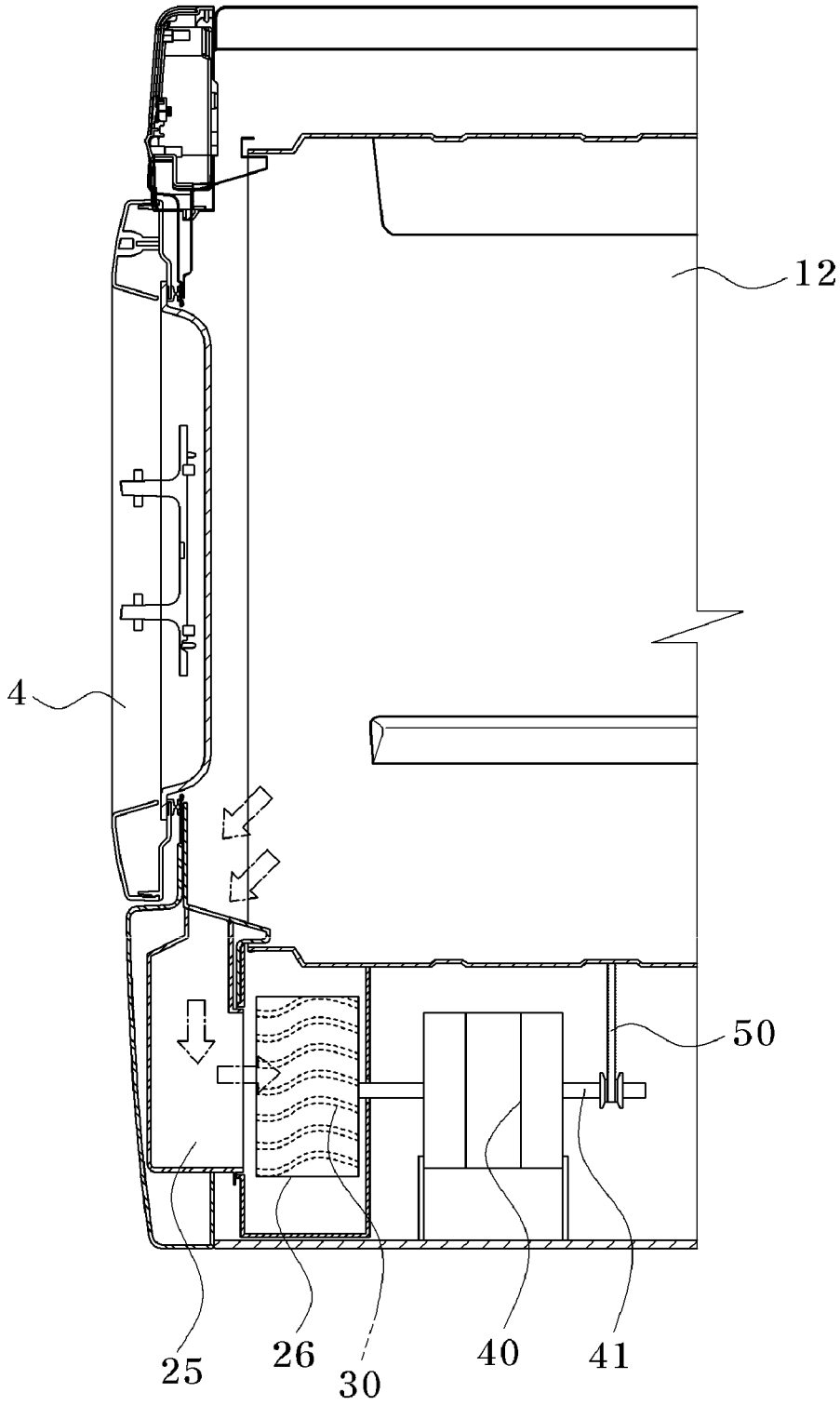
Fig. 2 Prior Art
FIG. 2 is a partially cross-sectional view of the conventional dryer.
Figure 3:
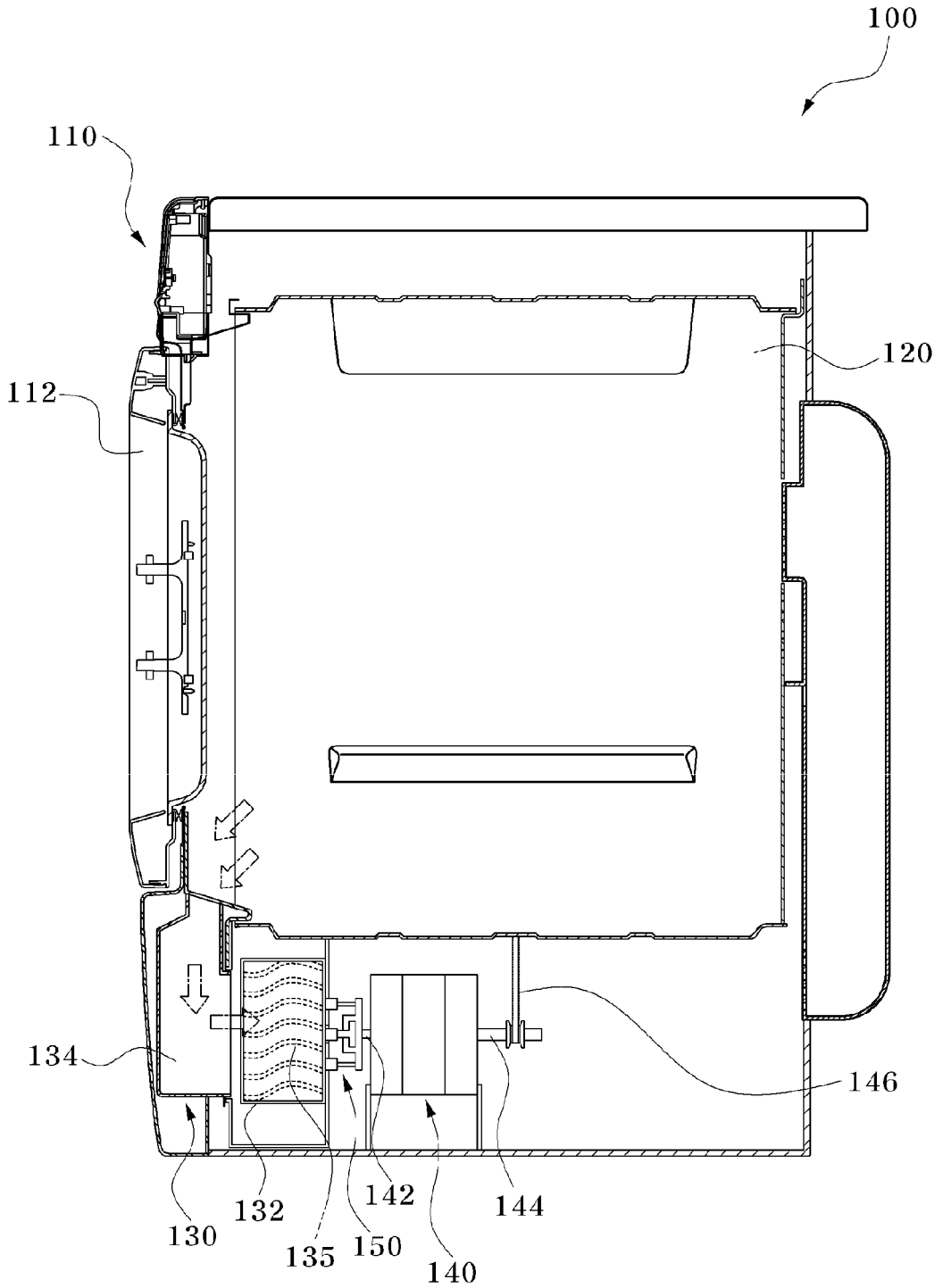
FIG. 3 is a cross-sectional view of a dryer according to one embodiment of the present invention.

Referring to FIG. 3, which is a partially cut perspective view of a dryer according to one embodiment of the present invention, a dryer 100 includes a cabinet 110, a drum 120, an exhaust part 130, a drive unit 140, and a drive force transmission unit 150.

The cabinet 110 constitutes an outer appearance of the dryer 100 and has a space defined therein. A door 112 is provided at the front of the cabinet 110 and an exhaust port (not shown) is formed at the rear of the cabinet 110.

The drum 120 is disposed inside the cabinet 110. The drum 120 receives laundry and is rotatably installed behind the door 112.

The exhaust part 130 is configured to exhaust air, which is used to dry laundry inside the drum 120, to an outside of the cabinet 110. The exhaust part 130 is located inside the cabinet 110 to communicate with the drum 120. The exhaust part 130 includes a ventilation fan 135.

The ventilation fan 135 guides intake and discharge of air. Specifically, the ventilation fan 135 serves to guide external air into the drum 120 while discharging air, which has passed the drum 120, to the outside of the cabinet 110.

The ventilation fan 135 is received in a fan housing 132. The fan housing 132 is connected at one side thereof to an exhaust pipe (not shown) connected to the exhaust port, and is connected at the other side thereof to a lint duct 134. The lint duct 134 communicates with an outlet of the drum 120 and is provided with a filter which separates foreign matter from air discharged from the lint duct 134.

The drive unit 140 is disposed inside the cabinet 110 to rotate the drum 120 and the ventilation fan 135. The drive unit 140 includes a dual-shaft motor which includes first and second rotational shafts 142, 144 integrally rotating. The first rotational shaft 142 is connected to the ventilation fan 135 to rotate the ventilation fan 135, and the second rotational shaft 144 is connected to the drum 120 to rotate the drum 120.

The ventilation fan 135 is rotated by a drive force transmitted from the first rotational shaft 142 via a drive force transmission unit 150 described below, and the drum 120 is rotated by a drive force transmitted from the second rotational shaft 144 via a belt 146.

Figure 4:
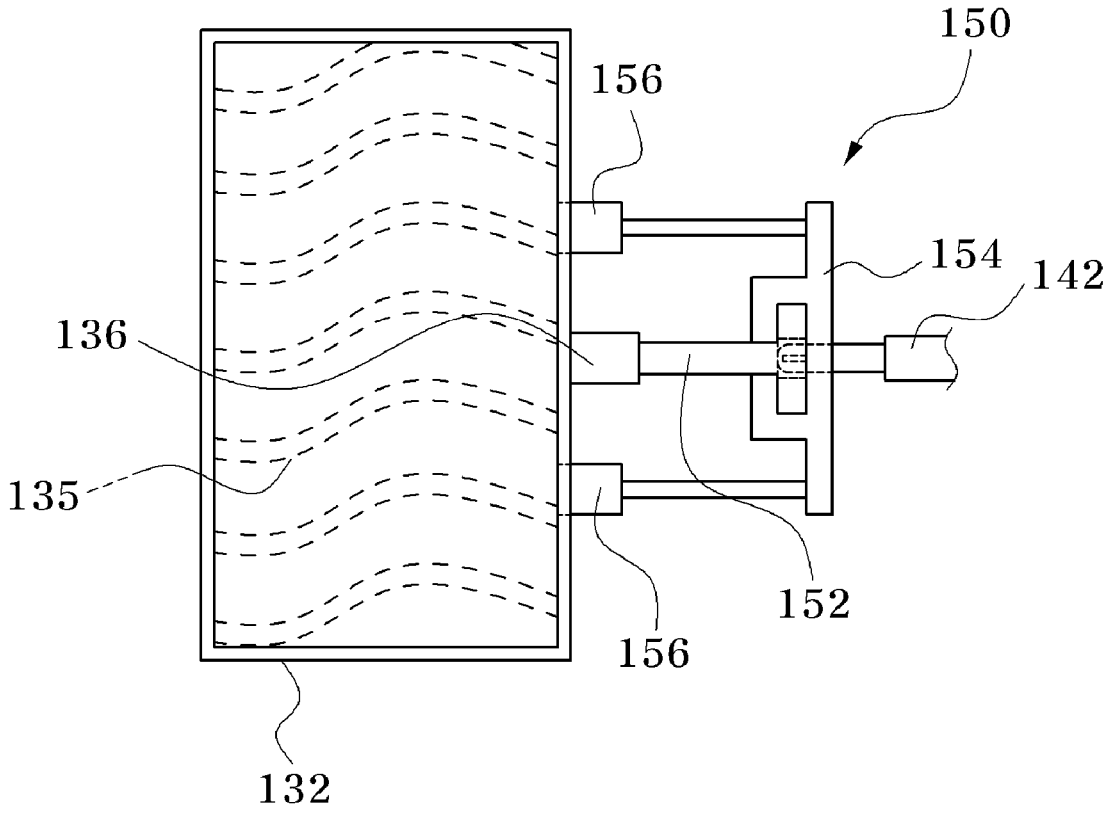
FIGS. 4 and 5 are enlarged views of a drive force transmission unit of the dryer shown in FIG. 3.
Figure 5:
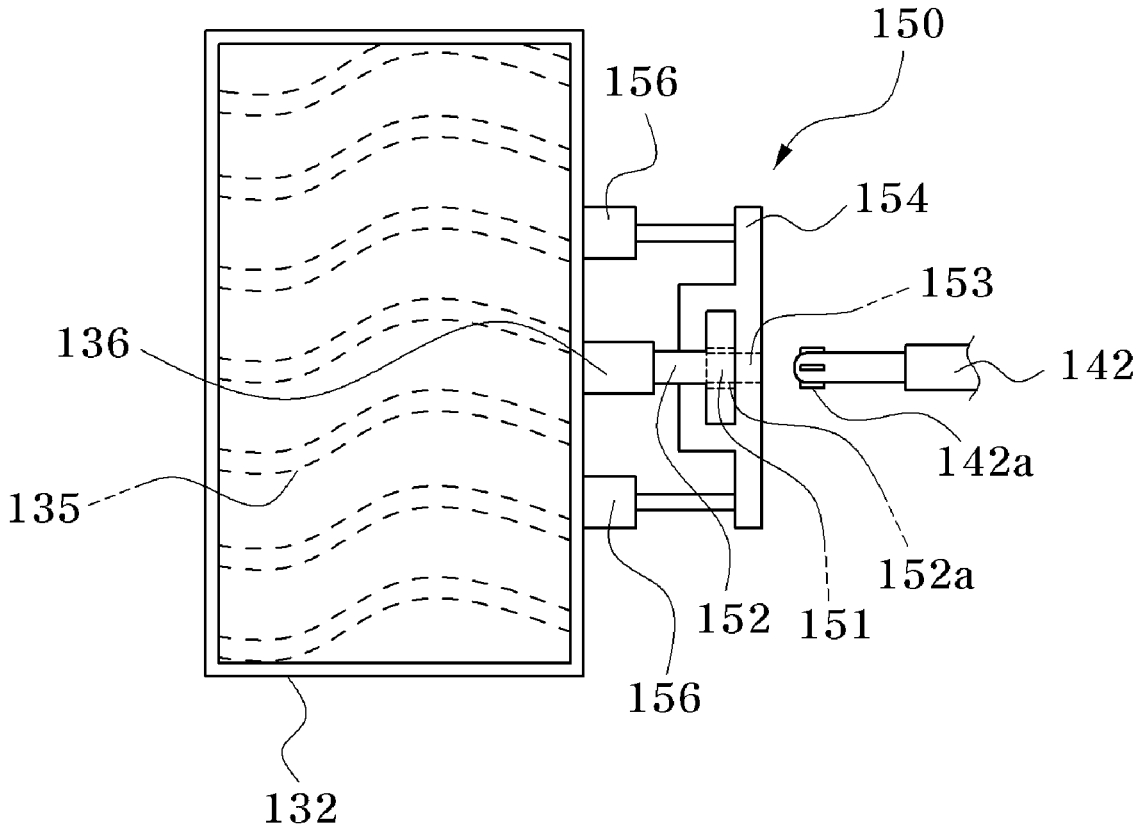

The drive force transmission unit 150 is configured to selectively transmit the drive force from the drive unit 140 to the ventilation fan 135. Referring to FIGS. 4 and 5, which are enlarged views of the drive force transmission unit of the dryer shown in FIG. 3, the drive force transmission unit 150 includes a first connection part 152, a second connection part 154, and a moving part 156.

The first connection part 152 is coupled to a central shaft 136 of the ventilation fan 135. Specifically, the first connection part 152 is inserted into the central shaft 136 of the ventilation fan 135 to be moved in an axial direction of the ventilation fan 135. In other words, the first connection part 152 is extendable from the central shaft 136 of the ventilation fan 135, and may be movably inserted into the central shaft 136 of the ventilation fan 135. The first connection part 152 is integrally rotated along with the central shaft 136 of the ventilation fan 135.

The first connection part 152 is formed at the center thereof with a fastening groove 151. Therefore, the first rotational shaft 142 is coupled to the first connection part 152 by inserting one end of the rotational shaft 142 into the fastening groove 151 of the first connection part 152. The first rotational shaft 142 has a tapered end and has a plurality of protrusions 142*a* formed on an outer circumferential surface thereof. On an inner circumferential surface of the first connection part 152 where the fastening groove 151 is formed, depressions 152*a* are formed to correspond to the protrusions 142*a*. Accordingly, when the first rotational shaft 142 is inserted into the fastening groove 151 of the first connection part 152, the protrusions 142*a* engage with the depressions 152*a*, so that the first rotational shaft 142 can be more securely couple to the first connection part 152.

The first connection part 152 is coupled at one end thereof to the second connection part 154. The second connection part 154 is rotatably coupled to the end of the first connection part 152 so as to be free from rotation of the first connection part 152. A bearing secured on the second connection part 154 may be provided to a portion where the first connection part 152 is coupled to the second connection part 154.

The second connection part 154 is formed at the center thereof with a through-hole 153. The first rotational shaft 142 passes through the through-hole 153 and is inserted into the fastening groove 151.

After being coupled to the first connection part 152, the second connection part 154 serves to connect or disconnect the first connection part 152 to or from the first rotational shaft 142 by moving the first connection part 152. A detailed description of this configuration will be given below.

The moving part 156 moves the second connection part 154. The moving part 156 can move the first connection part 152 by moving the second connection part 154. The moving part 156 may include a single or multiple actuators, each of which is coupled at one side thereof to the fan housing 132, and at the other side thereof to the second connection part 154.

Figure 6:
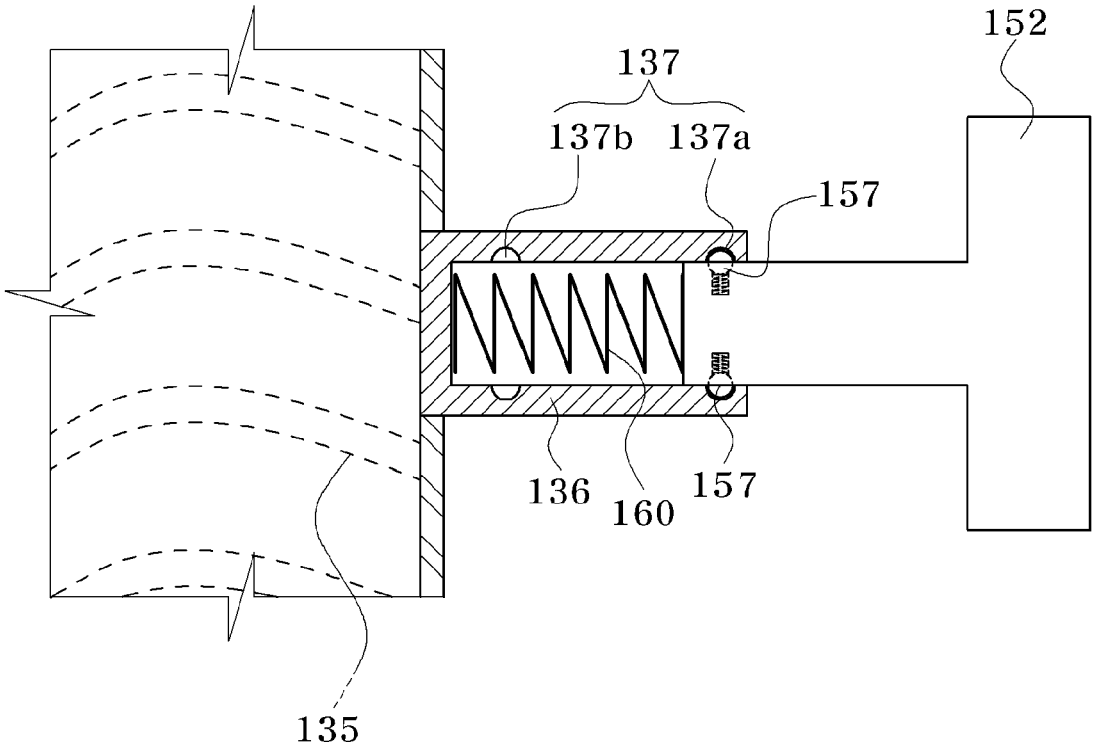
FIGS. 6 and 7 are cross-sectional views of the drive force transmission unit of FIGS. 4 and 5.
Figure 7:
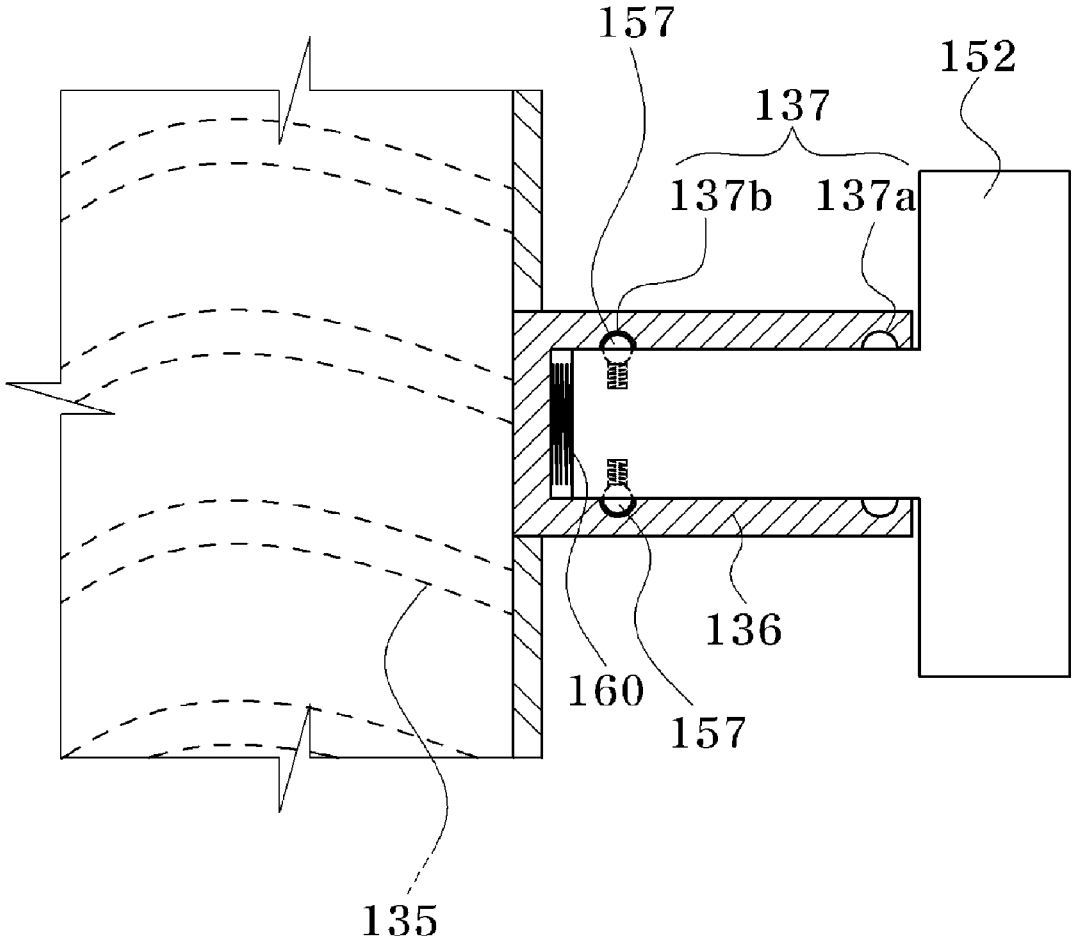

Referring to FIGS. 6 and 7, which are cross-sectional views of the drive force transmission unit of FIGS. 4 and 5, an elastic member 160 is provided between the ventilation fan 135 and the first connection part 152, which is inserted into the central shaft 136 of the ventilation fan 135. The elastic member 160 is inserted into the central shaft 136. The elastic member 60 may be a coil spring, one end of which is supported by the first connection part 152 and the other end of which is supported by the central shaft 136 of the ventilation fan 135.

The elastic member 160 provides an elastic restoration force for promoting movement of the first connection part 152. In other words, when the first connection part 152 is moved in a direction of being extended from the central shaft 136 of the ventilation fan 135 by the moving part 156 and the second connection part 154, the elastic member 160 promotes the movement of the first connection part 152, thereby allowing the first connection part 152 to be completely coupled to the first rotational shaft 142.

One of the central shaft 136 of the ventilation fan 135 and the first connection part 152 may be formed with a coupling protrusion 157 and the other may be formed with a coupling groove 137 which engages with the coupling protrusion 157.

In this embodiment, the coupling protrusion 157 is formed on the first connection part 152 and the coupling groove 137 is formed on an inner circumferential surface of the central shaft 136 of the ventilation fan 135. However, it should be noted that the present invention is not limited thereto.

The coupling protrusion 157 is formed on an outer circumferential surface of the first connection part 152, and the coupling groove 137 includes a first coupling groove 137*a* and a second coupling groove 137*b* separated from each other.

The coupling protrusion 157 and the coupling groove 137 serve to guide a finishing time point in movement of the first connection part 152.

In other words, when the first connection part 152 is moved in the direction of being extended from the central shaft 136 of the ventilation fan 135, the movement of the first connection part 152 continues until the coupling protrusion 157 engages with the first coupling groove 137*a* as shown in FIG. 6, thereby guiding the finishing time point in movement of the first connection part 152. On the contrary, when the first connection part 152 is moved in the direction of being inserted into the central shaft 136 of the ventilation fan 135, the movement of the first connection part 152 continues until the coupling protrusion 157 engages with the second coupling groove 137*b* as shown in FIG. 7, thereby guiding the finishing time point in movement of the first connection part 152.

In this embodiment, a ball spring is provided as one example of the coupling protrusion 157, but the present invention is not limited thereto.

Further, although the drive force transmission unit 150 is illustrated as being located at one side of the ventilation fan 135 in this embodiment, the present invention is not limited to this configuration. Alternatively, the drive force transmission unit 150 may be located at one side of the drive unit 140. In this case, the first connection part 152 is coupled to the first rotational shaft 142 so as to be moved in the axial direction of the first rotational shaft 142 and the moving part 156 is coupled to the drive unit 140. As a result, the first connection part 152 is moved by the second connection part 154 to be connected to or disconnected from the central shaft 136 of the ventilation fan 135.

Figure 8:
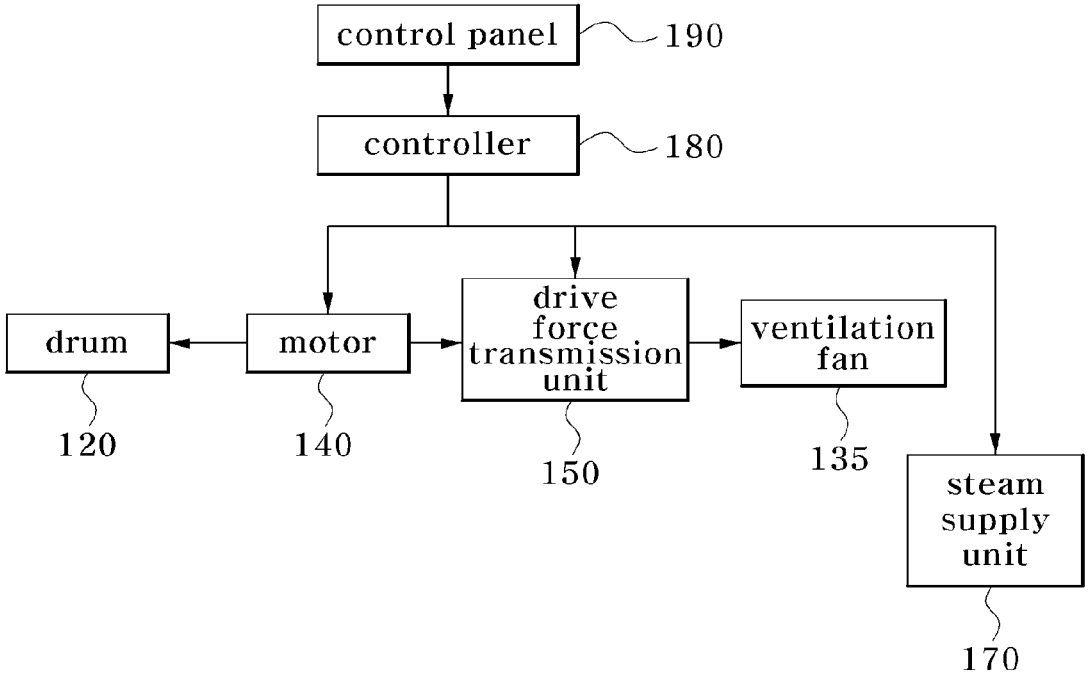
FIG. 8 is a configuration view of the dryer according to the embodiment of the present invention.

According to the embodiment of the invention, the dryer 100 further includes a steam supply unit 170 as shown in FIG. 8. The steam supply unit 170 is provided to spray steam into the drum 120. The steam supply unit 170 of the dryer according to this embodiment is similar to a steam supplying device of a conventional dryer, and a detailed description thereof will be omitted herein.

In addition, the dryer according to this embodiment of the invention includes a controller 180. The controller 180 controls general operations of the dryer 100, for example, operations of the drive force transmission unit 150, steam supply unit 170 and a heater (not shown). Furthermore, the controller 180 controls the drive force transmission unit 150 when the operation of the steam supply unit 170 is performed or stopped.

Figure 9:
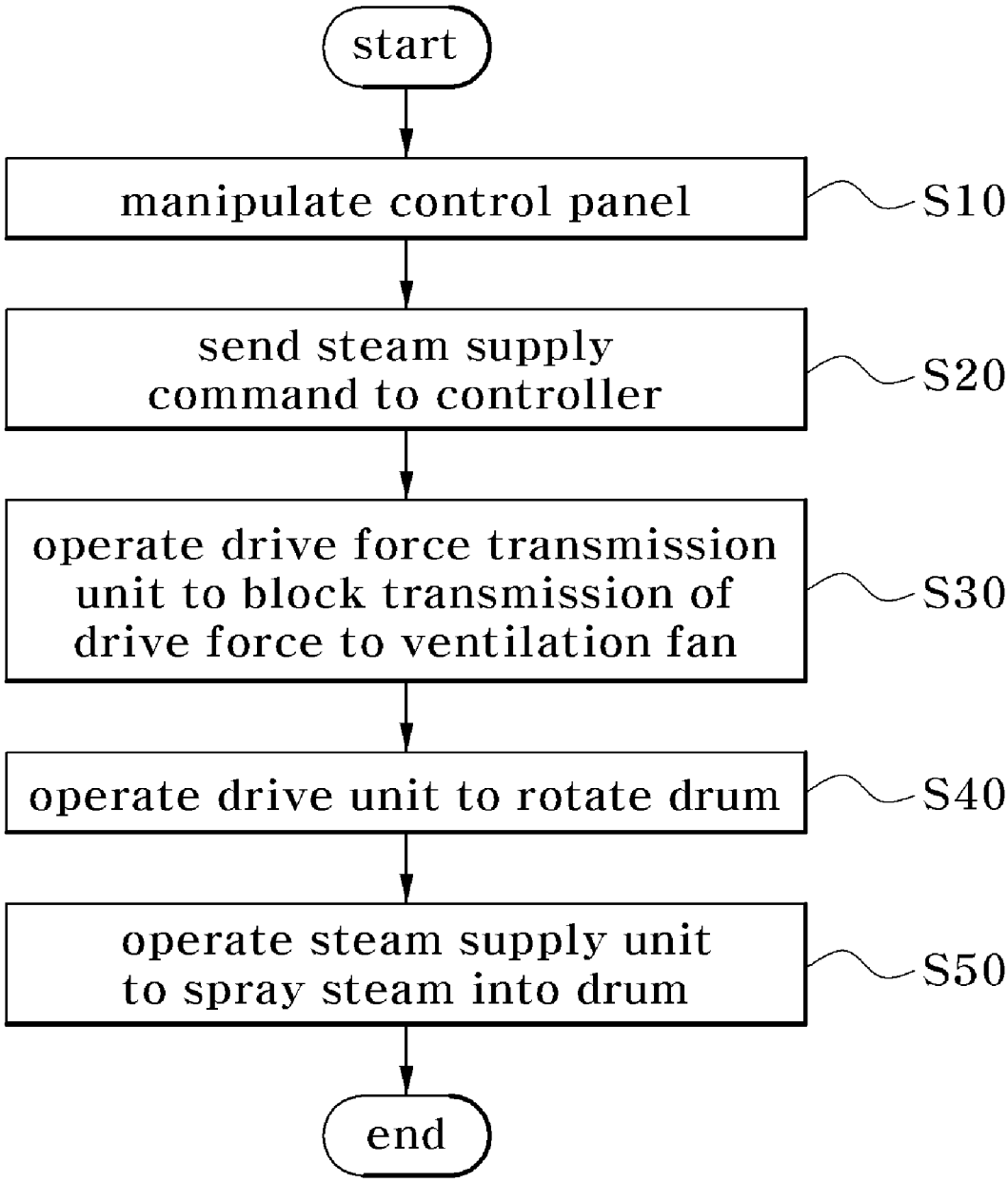
FIG. 9 is a flowchart of a method of controlling the dryer according to one embodiment of the present invention.

FIG. 9 is a flowchart of a method of controlling the dryer according to one embodiment of the present invention.

Next, a method of controlling the dryer according to one embodiment of the invention will be described with reference to FIGS. 3 to 9.

First, when a user manipulates a button for operation of the steam supply unit 170 on a control panel 190 in S10, a steam supply command is sent to the controller 180 in S20. Then, the controller 180 operates the drive force transmission unit 150 to block a drive force from being transmitted from the drive unit 140 to the ventilation fan 135 in S30. This operation will be described in more detail hereinafter.

When the drive force transmission part 150 is operated by the controller 180 in a state wherein the drive force can be transmitted from the drive unit 140 to the ventilation fan 135, that is, in a state wherein the first connection part 152 is connected to the first rotational shaft 142 as shown in FIG. 4, the moving part 156 is operated to move the second connection part 154 as shown in FIG. 5, so that the first connection part 152 is also moved along with the second connection part 154. In this case, the first and second connection parts 152, 154 are moved in a direction where the first connection part 152 is inserted into the central shaft 136 of the ventilation fan 135.

After being inserted into the first connection part 152 by movement of the first connection part 152, the first rotational shaft 142 is detached from the fastening groove 151 and is separated from the first connection part 152, so that the ventilation fan 135 is disconnected from the drive unit 140 and the drive force is blocked from being transmitted from the drive unit 140 to the ventilation fan 135.

Then, the controller 180 operates the drive unit 140. Here, since the first rotational shaft 142 of the drive unit 140 is disconnected from the ventilation fan 135, the drive force of the drive unit 140 is transmitted only to the second rotational shaft 144 and the drum 120 connected to the belt 146. As a result, the ventilation fan 135 is not operated and only the drum 120 is rotated in S40.

Furthermore, the controller 180 operates the steam supply unit 170 to spray steam into the drum 120 in S50.

Here, it is not necessary to perform the operation S30 of operating the drive force transmission unit 150 to the operation S50 of operating the steam supply unit 170 according to the aforementioned sequence. Rather, it should be noted that the sequence can be changed without deteriorating desired functions and effects which can be realized by the method of controlling the dryer according to the embodiment of this invention.

As apparent from the description, according to one embodiment of the invention, the dryer allows only the drum 120 to rotate while stopping rotation of the ventilation fan 135 using the drive force transmission unit 150 when a user sprays steam into the drum 120, thereby allowing the steam to be uniformly sprayed onto laundry inside the drum 120.

Although some embodiment have been provided to illustrate the present invention in conjunction with the drawings, it will be apparent to those skilled in the art that the embodiments are given by way of illustration only, and that various modifications and equivalent embodiments can be made without departing from the spirit and scope of the present invention. Accordingly, the scope of the present invention should be limited only by the accompanying claims.

What is claimed is:

1. A dryer comprising:

a cabinet;

a drum rotatably disposed inside the cabinet;

an exhaust part communicating with the drum and provided with a ventilation fan;

a drive unit rotating the drum and the ventilation fan; and a drive force transmission unit that is operable in a first configuration in which the drive force transmission unit connects the drive unit to the ventilation fan to transmit a drive force from the drive unit to the ventilation fan, and in a second configuration in which the drive force transmission unit disconnects the drive unit from the ventilation fan to prevent transmission of a drive force from the drive unit to the ventilation fan.

2. The dryer according to claim 1, wherein the drive unit comprises a dual-shaft motor including a first rotational shaft rotating the ventilation fan and a second rotational shaft rotating the drum.

3. The dryer according to claim 2, wherein the drive force transmission unit comprises a first connection part coupled to a central shaft of the ventilation fan to be moved in an axial direction of the ventilation fan; a second connection part to which the first connection part is rotatably connected, the second connection part connecting or disconnecting the first connection part to or from the first rotational shaft; and a moving part moving the second connection part.

4. The dryer according to claim 3, wherein the first rotational shaft is formed with a protrusion and the first connection part is formed with a depression engaging with the protrusion.

5. The dryer according to claim 3, wherein the first connection part is inserted into the central shaft of the ventilation fan, and an elastic member is disposed between the first connection part and the ventilation fan.

6. The dryer according to claim 5, wherein one of the central shaft of the ventilation fan and the first connection part is formed with a coupling protrusion and the other is formed with a coupling groove engaging with the coupling protrusion.

7. The dryer according to claim 6, wherein the coupling protrusion comprises a ball-spring.

8. The dryer according to claim 2, wherein the drive force transmission unit comprises a first connection part coupled to the first rotational shaft to be moved in an axial direction of the first rotational shaft; a second connection part to which the first connection part is rotatably connected, the second connection part connecting or disconnecting the first connection part to or from the central shaft of the ventilation fan; and a moving part moving the second connection part.

9. The dryer according to claim 1, further comprising:

a steam supply unit disposed inside the cabinet and spraying steam into the drum.

10. The dryer according to claim 9, further comprising:

a controller operating the drive force transmission unit when the steam generator is operated.

11. A method of controlling a dryer, comprising:

sending a steam supply command to a controller;

operating, by the controller, a drive force transmission unit to disconnect a drive unit from a ventilation fan and block a drive force from being transmitted from the drive unit to the ventilation fan;

operating, by the controller, the drive unit to rotate a drum; and operating, by the controller, a steam supply unit to spray steam into the drum.

* * * * *